United States Patent [19]

Garrison et al.

[11] 4,309,796

[45] Jan. 12, 1982

[54] CARDING TRASH REMOVING APPARATUS AND METHOD

[75] Inventors: Joe K. Garrison, Piedmont; Brian C. Claycomb, Taylors, both of S.C.

[73] Assignee: John D. Hollingsworth On Wheels, Inc., Greenville, S.C.

[21] Appl. No.: 53,760

[22] Filed: Jul. 2, 1979

[51] Int. Cl.[3] ..... D01G 15/82

[52] U.S. Cl. ..... 19/98; 19/107

[58] Field of Search ..... 19/98, 107, 104, 108–111, 19/113

[56] References Cited

U.S. PATENT DOCUMENTS

| | | | |
|---|---|---|---|
| 205,805 | 7/1878 | Moog | 19/98 |
| 334,872 | 1/1886 | Keene | 19/98 |
| 466,846 | 6/1892 | Dobson et al. | 19/98 |
| 2,879,549 | 3/1959 | Miller et al. | 19/98 X |
| 3,120,030 | 2/1964 | Reiterer | 19/109 X |
| 3,387,337 | 6/1968 | Growley | 19/107 |
| 3,737,952 | 6/1973 | O'Neal et al. | 19/107 |
| 3,858,276 | 1/1975 | Hollingsworth | 19/98 |
| 4,011,631 | 3/1977 | Estebanell | 19/104 X |
| 4,219,908 | 9/1980 | Winch | 19/104 X |

FOREIGN PATENT DOCUMENTS

| | | | |
|---|---|---|---|
| 1105774 | 4/1961 | Fed. Rep. of Germany | 19/98 |
| 1366786 | 6/1964 | France | 19/107 |
| 971830 | 10/1964 | United Kingdom | 19/107 |
| 2003202 | 3/1979 | United Kingdom . | |

*Primary Examiner*—Louis Rimrodt

*Attorney, Agent, or Firm*—Bailey, Dority & Flint

[57] ABSTRACT

A carding apparatus is illustrated wherein trash removal means is provided utilizing a carding flat means together with a first plate carried for vertical adjustment relative to the flat means for varying the setting between the plate and a clothed carding cylinder. A second plate has means for setting a surface thereof in close proximity to the surface of the clothed cylinder. A relatively wide setting is provided for the first plate and a slot is formed by the first and second plates which will be self-expelling of trash, short fibers and the like by reason of such wide setting of the first plate followed by the close setting of the second plate acting as an air barrier upon the opened fibers carded by the carding flat means. A suction plenum provides a system of removing a large part of the already expelled trash so as to greatly improve the carding operation while minimizing loss of desirable longer fibers.

8 Claims, 4 Drawing Figures

CARDING TRASH REMOVING APPARATUS AND METHOD

BACKGROUND OF THE INVENTION

A trash removal apparatus is illustrated in U.S. Pat. No. 3,737,952 wherein overlapping cover plates are employed to provide for a reversely directed air release through the shroud formed by the cover plates. It has also been contemplated that the second of the plates facing in the direction of rotation of the carding element be set closer to the carding element than the first of the plates so as to form a self-expelling slot. The prior art also includes British Pat. No. 2,003,202 published Mar. 7, 1979 which illustrates the use of gaps formed between stationary flats positioned in edge-to-edge adjacent relationship with suction means for withdrawing air including dust and fly through the gaps.

BRIEF DESCRIPTION OF THE INVENTION

It has been found that a pair of spaced plates or similar elements having surfaces adapted to be carried in set relation to a rotating carding cylinder may be positioned between carding flat elements used in connection with a clothed rotating cylinder. Provision is made to set these plates to the rotating cylinder wherein the first may utilize an open setting, with the second plate set in closer relation so as to create a barrier to the air causing dust and short fiber to emerge from the opening between the spaced plates. It is preferred that at least one of the plates carried between the carding flats be mounted for vertical adjustment on one of the flats. It is also important that several of these arrangements be carried between stationary flats so as to form several removal points for trash in order to obviate the necessity for other trash removing apparatus and to better utilize the stationary flats to avoid any necessity for the use of rotating flats. If desired, apparatus constructed in accordance with the invention may be utilized in connection with the usual revolving flats. It is contemplated that the second plate hereof which is set closely to the clothed cylinder, be constructed so as to have a sharp edge facing in the direction of the rotation of the clothed cylinder as illustrated in U.S. Pat. No. 3,858,276.

Accordingly, it is an important object of the invention to provide a slot means which is self-expelling of dirt and trash and short fibers so that, in contrast to the British patent identified above, the plenum will merely carry away trash which has been expelled from the slot formed by the plate elements inserted between the stationary flats. In the British patent, the suction apparatus includes a plenum which is probably closed on one end so as to exert the suction necessary to withdraw trash from the slot probably withdrawing long fibers along with the trash.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
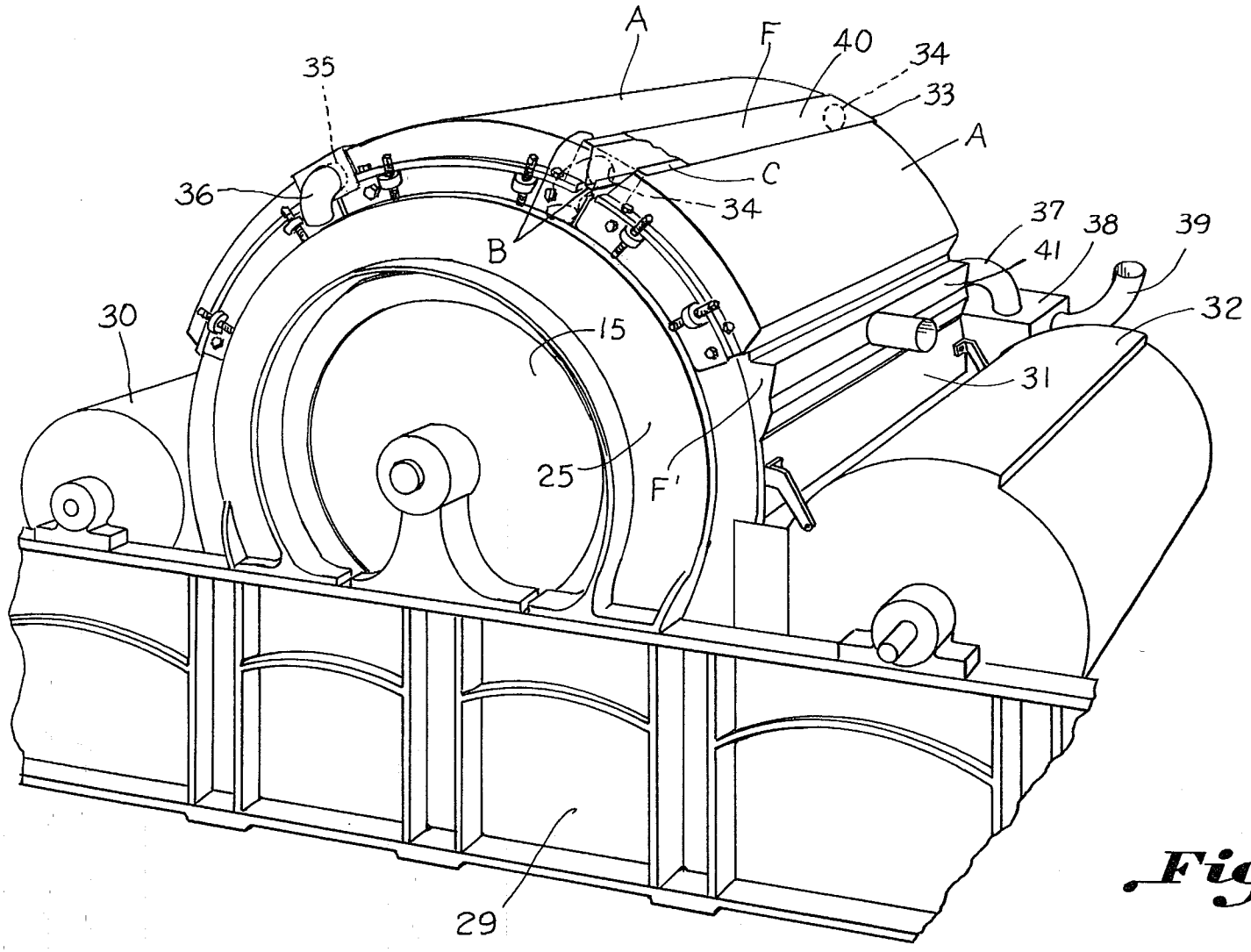
FIG. 1 is a perspective view of a card equipped with trash removal apparatus constructed in accordance with the present invention.

The drawings illustrate trash removal apparatus for a carding machine having a clothed cylinder. A stationary flat A carrying card clothing on an inner surface thereof is positioned in a carding relation to the clothed cylinder. A first plate means B is carried for vertical adjustment relative to the stationary flat varying the setting between the first plate means and the clothed cylinder. A second plate means C is provided with means D mounting same in closely set relation to the clothed cylinder. Means E mount the first and second plate means in circumferentially spaced relation to each other adjacent a trailing edge of the stationary flat forming a slot. Thus, the first and second plates are so set in relation to the clothed cylinder that the second plate acts as a barrier causing the slot to be self-expelling of trash, short fibers and the like. It is important that the second plate has a sharp edge opposite the clothed cylinder as shown in the drawings. A plenum F opens along the slot and has a course of suction on one end and an opening on the other end for removing trash, short fibers and the like expelled from the slot.

The method of carding textile fibers utilizing a stationary carding flat having card clothing carried by an inner surface thereof in carding relation to a clothed cylinder contemplates subjecting the textile fibers to the carding action of the carding flat and the cylinder. Then the setting upon the fibers is opened prior to passage of the fibers on the cylinder past an open slot; and thereafter closing the setting upon the fibers to act as a barrier to the extent that the slot is self-expelling of trash, short fibers and the like responsive to air currents generated by rotation of the cylinder. These steps are repeated while removing the trash, short fibers and the like thus expelled by subjecting the slots to the action of air plenums along respective slots.

Figure 2:
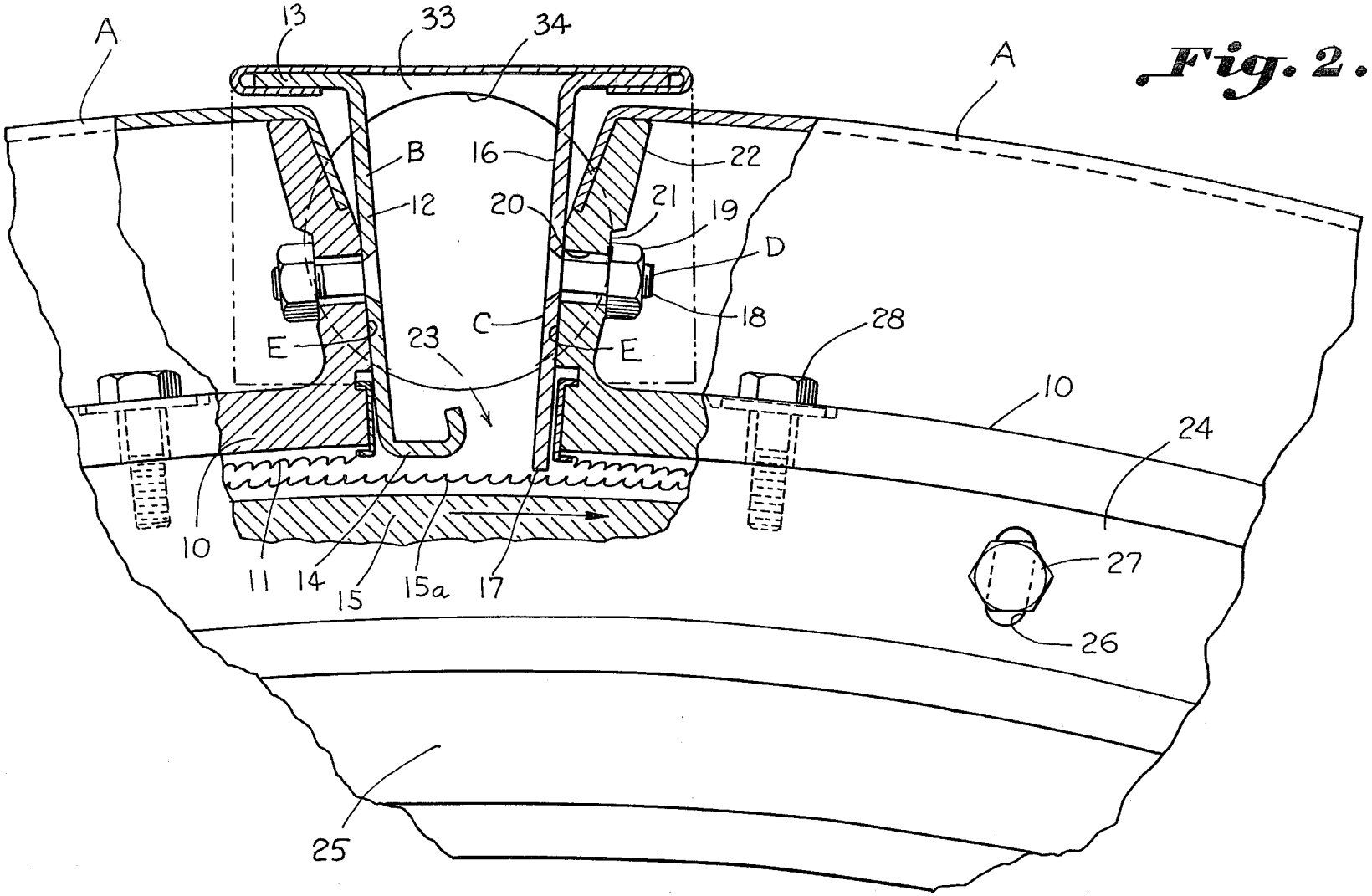
FIG. 2 is an enlarged side elevation illustrating trash removal apparatus constructed in accordance with the present invention positioned between stationary flats.

The stationary flat A may be of any desired type but is preferably such as illustrated in U.S. Pat. Nos. 3,604,062 and 3,604,475. The stationary flat A includes a plate 10 and card clothing 11 carried by an inner face thereof. A first plate element or means B is illustrated as being mounted upon the trailing edge of a first stationary flat A. The first plate means B is illustrated as including an upstanding portion 12 which may have an upper outwardly extending flange 13 for forming one of a pair of opposed flanges constituting a part of an air duct or plenum described below. The plate B has a laterally extending portion 14 which is set at a wide distance with respect to the clothing of the cylinder and may be from 0.060 to 0.100 inch setting. This setting is shown in FIG. 2 to be greater than the setting of the flat A thus, opening the setting. A main cylinder 15 carries card clothing 15*a* to which the various settings are made.

The second plate means C is illustrated in FIGS. 1 and 2 having an upstanding portion 16 and a lower edge or plate surface 17. The plate surface 17 is set at a narrow or close setting with respect to the clothing 15 of the cylinder. This setting may be between 0.015 to 0.025 inch and such a setting has been found to be satisfactory. This setting is shown in FIG. 2 to be less than the setting of the first plate, thus closing the setting.

The means D for mounting the second plate in position includes a threaded member carried by the plate C as illustrated at 18 together with a nut 19 which is received within the slot 20, which accommodates the threaded member and permits vertical adjustment of the plate and securement of the nut against a recess 21 in an upstanding portion 22 at the end of the next succeeding carding flat A. The plates B and C are mounted on upright flat end portions E carried by opposed ends of adjacent flats. It will be observed that a gap which may be approximately from $\frac{1}{4}$ inch to $\frac{7}{8}$ inch and preferably $\frac{1}{2}$ inch is broadly designated at 23 between the plates B and C. It is important to note that the flats A may be carried upon a mounting segment 24 which is, in turn, secured to the arch 25 for vertical adjustment within the slot 26 by the bolt 27. The bolt 28 secures the plate portion 10 of the flats A upon the segments 24 located on the outside of the card arches 25 (FIG. 2).

FIG. 1 illustrates a licker-in at 30 with a plurality of flats A circumferentially mounted about the main cylinder 15. Adjacent the front of the card, a door 31 is spaced the last of the series of stationary flats and in advance of the doffer 22.

Plenums F are illustrated as being formed by end members 33 which have openings 34 therein for accommodating a reduced end portion 35 of a downwardly extending elbow 36 which is positioned to provide openings in the end of the plenums F. A suitable connection such as by respective connectors 37 is provided for connecting each of the plenums F to a suction plenum 38, which is connected to a suitable source of suction through the duct 39. Each of the ducts F includes a cover plate 40 which extends and is suitably fixed between the end members 33.

OPERATION

Thus, the apparatus and method hereof operate to remove dust, trash, short fibers and the like utilizing stationary carding flats but such may be accomplished with other types of carding wherein whole or partial movable flat strips are employed provided the plates described herein are positioned in similar fashion to that shown, i.e., after some carding has taken place on the cylinder. The apparatus hereof utilizes low and high pressure differentials to liberate dust, short fiber and trash from the fiber mass on the clothed card cylinder 15. The setting of the plates A may be in the range of normal flat settings. The setting of the plate B is wide creating a low pressure area which is followed by an air dam or barrier effect created by the close setting of the surface 17 of the member C. The air dam effect creates a barrier to all small particles of dust, trash and short fiber not firmly held by the cylinder wire causing them to be blown off through the slot 23 and into the suction afforded by the plenum. It is important that the plenum exert suction transversely of the card along the slot between the openings 34 in the end members 33 so as to avoid a suction slot effect as would withdraw trash from the opening 23.

Figure 3:
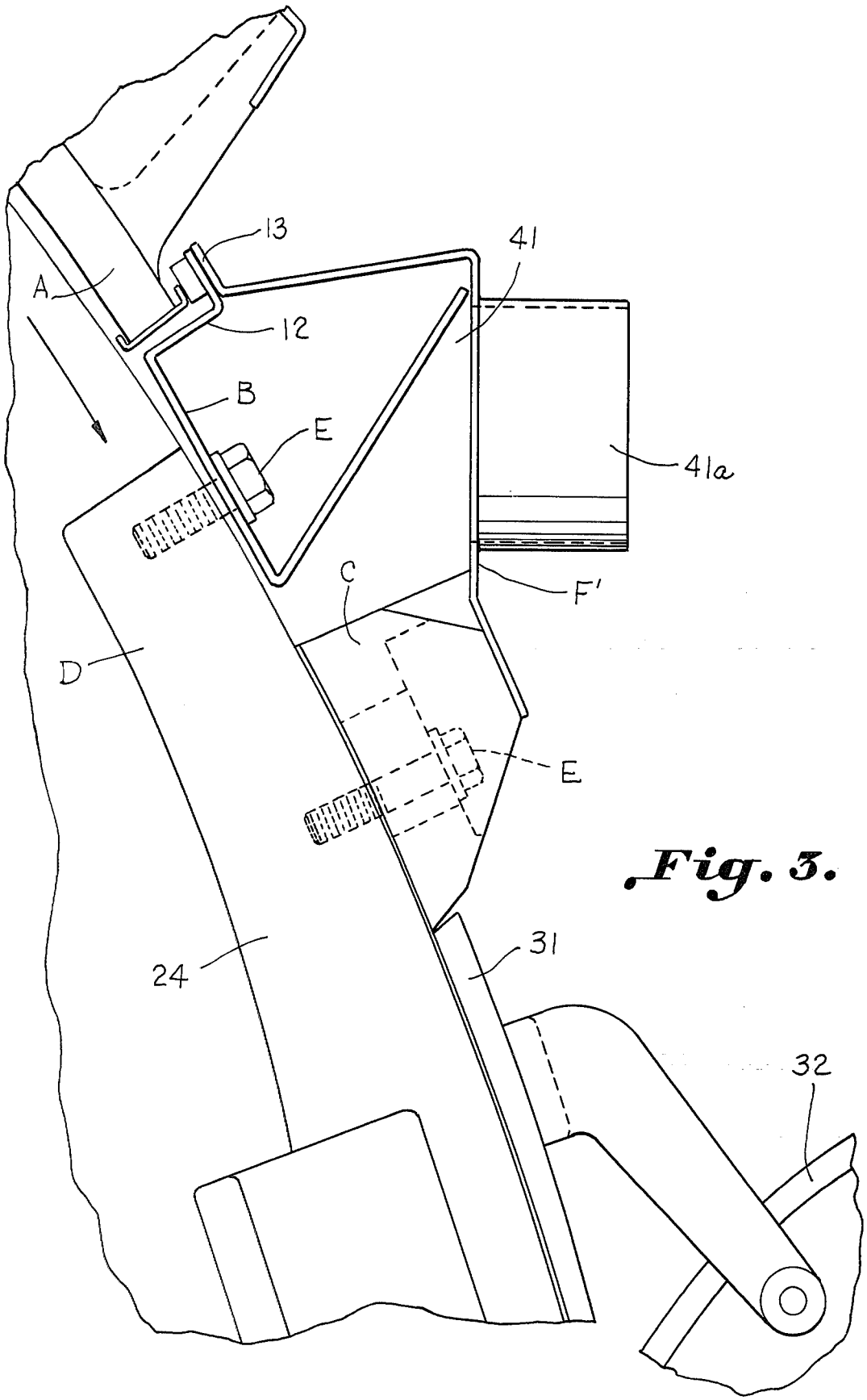
FIG. 3 is a side elevation illustrating a top front plate with trash removal apparatus constructed in accordance with the present invention.

It will be noted by reference to FIG. 3 that a special plenum F′ is created between the last of the series of plates A and door 31 by the end and cover plates designated at 41. A connection to a suitable source of suction is shown at 41*a*. The first plate 13 has an extra bend at an end opposite the flange 13 which extends from the vertical portion 12. The second plate C is a block having a sharpened leading edge as described above and the forward surface inclines rearwardly at an angle of about 5 degrees which has been found to produce desirable results in terms of maximum trash removal. The fastening means E mount the plates for adjustment as by utilizing suitable shims (not shown) upon the segments 24.

Figure 4:
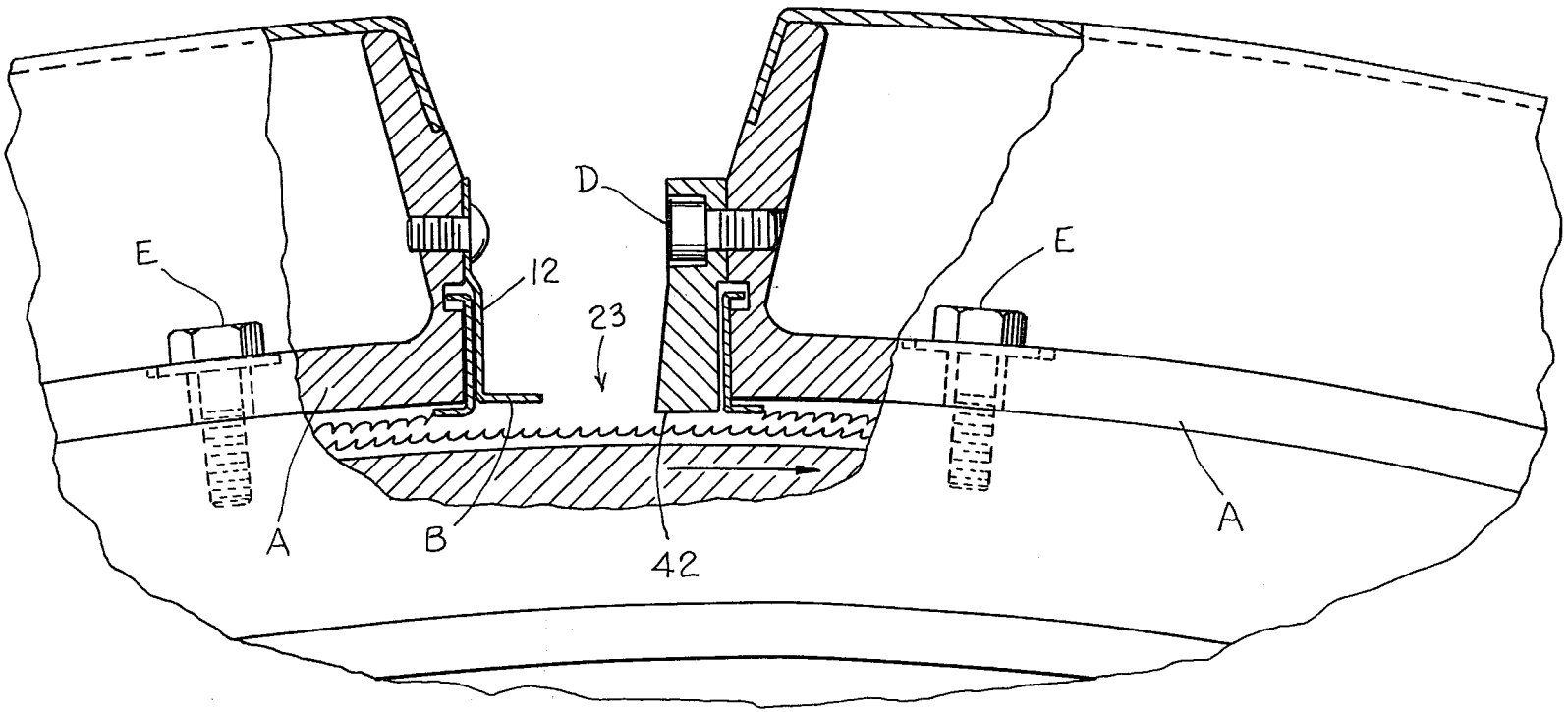
FIG. 4 is a side elevation similar to FIG. 2 illustrating a modified form of the invention.

FIG. 4 illustrates another modified form of the invention wherein the surface 14 is terminated without the upturned end portion and wherein a block provides a lower plate surface 42. A sharpened leading edge is also provided facing the oncoming teeth of the metallic card clothing 15*a*. Experiments indicate that if such edges were rounded or filleted little if any trash would be removed.

While a preferred embodiment of the invention has been described using specific terms, such description is for illustrative purposes only, and it is to be understood that changes and variations may be made without departing from the spirit or scope of the following claims.

What is claimed is:

1. Trash removal apparatus for a carding machine having a clothed cylinder comprising:

a stationary flat carrying card clothing on an inner surface thereof in a carding relation to said clothed cylinder;

a first plate carried for vertical adjustment relative to said stationary flat varying the setting between the first plate and said clothed cylinder;

a second plate independent of said first plate;

means mounting said second plate in closely set relation to said clothed cylinder;

means mounting said first and second plates in circumferentially spaced relation to each other adjacent a trailing edge of said stationary flat forming a slot; and said first plate being carried adjacent said stationary flat;

whereby said first and second plates are so set, independently of each other, in relation to said clothed cylinder that said second plate acts as a barrier causing said slot to be self-expelling of trash, short fibers and the like.

2. The structure set forth in claim 1, wherein said second plate has a sharp edge adjacent said clothed cylinder facing the direction of rotation thereof.

3. The structure set forth in claim 2 including a plenum opening along said slot and having a source of suction on one end and an opening on the other end for removing trash, short fibers and the like expelled from said slot.

4. Trash removal apparatus for a carding machine having a clothed cylinder comprising:

a stationary flat carrying card clothing on an inner surface thereof in a carding relation to said clothed cylinder;

a first plate carried for vertical adjustment relative to said stationary flat varying the setting between the first plate and said clothed cylinder;

a second plate independent of said first plate;

means mounting said second plate in closely set relation to said clothed cylinder;

means mounting said first and second plates in circumferentially spaced relation to each other forming a slot; and said first plate being carried adjacent said stationary flat;

whereby said first and second plates are so set, independently of each other, in relation to said clothed cylinder that one of said plates, being set closer with respect to said clothed cylinder than the other, acts as a barrier causing said slot to be self-expelling of trash, short fibers and the like.

5. The structure set forth in claim 4 wherein said second plate has a sharp edge adjacent said clothed cylinder facing the direction of rotation thereof including, a plurality of said slots, and a plenum opening along each of said slots having a source of suction on one end and an opening on the other end for removing trash, short fibers and the like expelled from said slots.

6. Trash removal apparatus for a carding machine having a clothed cylinder, a first stationary flat carrying a card clothing on an inner surface thereof in a carding relation to said clothed cylinder, and a second stationary flat carrying card clothing on an inner surface thereof in a carding relation to said clothed cylinder, comprising:

a first plate carried for vertical adjustment between said stationary flats varying the setting between the first plate and said clothed cylinder;

a second plate between said first and second stationary flats independent of said first plate;

means mounting said second plate in closely set relation to said clothed cylinder;

means mounting said first and second plates in circumferentially spaced relation to each other forming a slot; and said second plate having a sharp edge adjacent said clothed cylinder facing the direction of rotation thereof;

whereby said first and second plates are so set, independently of each other in relation to said clothed cylinder that one of said plates, being set closer with respect to said clothed cylinder than the other, acts as a barrier causing said slot to be self-expelling of trash, short fibers and the like.

7. The structure set forth in claim 6 including a plenum opening along said slot having a source of suction on one end and an opening on the other end for removing trash, short fibers and the like expelled from said slots.

8. A method of carding textile fibers utilizing a stationary carding flat having card clothing carried by an inner surface thereof in carding relation to a clothed cylinder comprising the steps of:

subjecting said textile fibers to the carding action of said carding flat and said cylinder;

then providing a first plate set more distantly from the clothed cylinder than said flat thus opening the setting upon said fibers prior to passage of the fibers on the cylinder past an open slot;

thereafter providing a second plate independent of said first plate set more closely to the clothed cylinder than said first plate thus closing the setting upon said fibers to act as a barrier to the extent that said slot is self-expelling of trash, short fibers and the like responsive to air currents generated by rotation of the cylinder; and repeating the aforesaid steps while removing the trash, short fibers and the like thus expelled by subjecting the slots to the action of an air suction plenum opening along said slots.

* * * * *